US008056515B2

(12) United States Patent
Hedman

(10) Patent No.: US 8,056,515 B2
(45) Date of Patent: Nov. 15, 2011

(54) METHOD AND DEVICE FOR THE OPERATION OF A VALVE OF THE COMBUSTION CHAMBER OF A COMBUSTION ENGINE, AND A COMBUSTION ENGINE

(75) Inventor: Mats Hedman, Eskilstuna (SE)

(73) Assignee: Cargine Engineering AB, Helsingborg (SE)

( * ) Notice: Subject to any disclaimer, the term of this patent is extended or adjusted under 35 U.S.C. 154(b) by 640 days.

(21) Appl. No.: 12/160,966

(22) PCT Filed: Jan. 16, 2007

(86) PCT No.: PCT/SE2007/000028

§ 371 (c)(1),
(2), (4) Date: Nov. 28, 2008

(87) PCT Pub. No.: WO2007/081274

PCT Pub. Date: Jul. 19, 2007

(65) Prior Publication Data

US 2009/0211546 A1 Aug. 27, 2009

(30) Foreign Application Priority Data

Jan. 16, 2006 (SE) ..... 0600077

(51) Int. Cl.
*F01L 9/02* (2006.01)

(52) U.S. Cl. ..... 123/90.12; 123/90.14; 91/403; 92/85 B; 137/625

(58) Field of Classification Search ..... 123/90.11, 123/90.12, 90.13, 90.14; 92/85 B; 91/392, 91/403; 137/625
See application file for complete search history.

(56) References Cited

U.S. PATENT DOCUMENTS

| | | | | |
|---|---|---|---|---|
| 5,522,358 | A | 6/1996 | Clarke | |
| 5,694,893 | A | 12/1997 | Chan et al. | |
| 7,472,669 | B2 * | 1/2009 | Hedman | 123/90.12 |

FOREIGN PATENT DOCUMENTS

| | | | |
|---|---|---|---|
| DE | 371718 | C | 3/1923 |
| DE | 4232573 | A1 | 4/1993 |
| DE | 4333493 | A1 | 10/1993 |
| GB | 2340881 | A | 3/2000 |

* cited by examiner

*Primary Examiner* — Ching Chang
(74) *Attorney, Agent, or Firm* — Pierce Atwood, LLP; Kevin M. Farrell; Katherine A. Wrobel

(57) ABSTRACT

A device for the operation of a valve (5) to the combustion chamber (6) of a combustion engine, wherein the combustion engine comprises a cylinder, a piston (3) displacably arranged in the cylinder (2), and a combustion chamber (6) delimited by the cylinder (2) and the piston (3), and said valve (5), and wherein the device comprises a valve actuator (7) that comprises an actuator chamber (8), an actuator piston (9) displacably arranged in the latter and arranged to drive the valve (5), and a communication channel (11) through which a pressure fluid is conducted into the combustion chamber (8) for the driving of the actuator piston (9) and, thereby, the valve (5) in a direction in which the valve (5) is opened. The communication channel (11) extends from the combustion chamber (6) to the actuator chamber (8), and said pressure fluid comprises fluid pressurized by the pressure in the combustion chamber (6).

23 Claims, 7 Drawing Sheets

METHOD AND DEVICE FOR THE OPERATION OF A VALVE OF THE COMBUSTION CHAMBER OF A COMBUSTION ENGINE, AND A COMBUSTION ENGINE

THE FIELD OF THE INVENTION

The present invention relates to a method for the operation of a valve of the combustion chamber of a combustion engine, said combustion engine comprising a cylinder, a piston which is displacebly arranged in the cylinder, and a combustion chamber delimited by said piston and said cylinder, and said valve, and a valve actuator that comprises an actuator piston provided to drive the valve and arranged in an actuator chamber, wherein a pressure fluid is conducted into the actuator chamber for the purpose of driving the actuator piston and the valve.

The invention also relates to a device for the operation of a valve of the combustion chamber of a combustion engine, said combustion engine comprising a cylinder, a piston displacebly arranged in the cylinder, and a combustion chamber delimited by the cylinder and said piston, and said valve, wherein the device comprises a valve actuator that comprises an actuator chamber, an actuator piston a displacebly arranged inside said actuator chamber and arranged to drive said valve, and a communication channel through which a pressure fluid is conducted into the actuator chamber for the purpose of driving the actuator piston, and thereby the valve, in the direction in which the valve is opened.

The invention also relates to a combustion engine provided with a device according to the invention, preferably a combustion engine with freely operable engine valves driven by means of pressure fluid. In particular, such a combustion engine is arranged to propel a vehicle such as a car or a lorry. Accordingly, the invention may comprise such a vehicle provided with said combustion engine.

THE BACKGROUND OF THE INVENTION AND PRIOR ART

It is a well known fact that the more a combustion engine provided with opened valves in the cylinder head is loaded, and the higher will the cylinder pressure be when the outlet valves are to be opened and the more energy will be required for the opening thereof. This fact is regardless of the method used for the opening of the valves. A problem encountered by a pneumatically, electromagnetically or hydraulically activated valve opening, but not encountered by cam shaft activated valve opening, is the opening against high cylinder pressures upon evacuation of combustion gases. The main problem is that the dimensioning of the valve opening power has to be adopted to the highest cylinder pressure instead of the most common cylinder pressure, which is substantially lower than the highest pressure. If the operation of the valve is done by a means such as a pressure fluid or an electromagnet, the power of this means must, with contemporary technology, be dimensioned in order to be able to perform a valve opening against the force generated by the maximum cylinder pressure. It would be desirable to reduce this need of over dimensioning.

Furthermore, a high pressure in the cylinder will, when the exhaust gases are evacuated, result in a waste of energy in the sense that a possible expansion work is not made use of (however if there is a turbo, some of the energy will be made use of).

The motor-braking technique for vehicles can be developed as to capacity and controllability, and for power-saving purposes. In vehicles with combustion engines such as heavy lorries, motor-braking is actively used as a supplement to the ordinary braking system. One such method comprises exhaust gas-braking, by which the evacuation of the exhaust gases out of the cylinder of the engine is inhibited. As an alternative, air is permitted to leak out into the exhaust gas system during the compression strokes. A problem of the methods as of today is the fact that a maximum braking effect and the possibility of controlling the braking effect is unsatisfactory. In connection to this problem, and with relevance for light vehicles, there is a possibility of storing brake energy upon motor-braking. There are known suggestions of how to conduct compressed air to a tank upon motor-braking, and to use the stored energy when there is a subsequent need of acceleration. There is a common feature of both light weight and heavy weight vehicles that a good controllability and high brake efficiency and energy saving by means of compressed air is enabled through the use of freely operable valves in the cylinder head of the engine. In this context, upon use of freely operable valves, it might be a problem that the cylinder pressure will be high during compression strokes, resulting in a need of a large amount of energy for the purpose of opening the valves. A large engine load is another operation mode that presents a relatively high cylinder pressure when the exhaust gases are to be evacuated.

THE OBJECT OF THE INVENTION

A primary object of the present invention is, for a combustion engine with a freely operable, pneumatically activated outlet valve, to enable the latter to open with good operational economy at all cylinder pressures that might be encountered during motor-braking and exhaust gas evacuation.

SUMMARY OF THE INVENTION

The object of the invention is achieved by means of the initial defined method, characterized in that a pressure fluid pressurized by the pressure in the combustion chamber is conducted to the actuator chamber for the purpose of driving the actuator piston in a direction in which the valve is opened in connection to an opening of the valve. A pneumatic valve-opener will, as suggested herein, use the cylinder pressure as the source of energy, and will, during motor-braking, open an outlet valve against any cylinder pressure that might be present. Accordingly, the valve-opener will, upon exhaust gas evacuation, use the energy in the remaining work potential. The pressurized pressure fluid is preferably, but not necessarily, the gas or gas mixture present in the combustion chamber.

According to a preferred embodiment, said pressure fluid is conducted to the actuator chamber through a communication channel that extends from the combustion chamber to the actuator chamber. Preferably, the communication in said channel is controlled by means of a pilot valve. The valve to the combustion chamber will then form a slave valve in relation to said pilot valve. The pilot valve may have a surface area towards the pressure fluid from the combustion chamber that is substantially smaller than the corresponding surface area of the controlled slave valve. Thereby, the means for driving the pilot valve may be given a dimension which is substantially smaller than that of a corresponding means for the driving of the above said mentioned slave valve would have been if the driving thereof could not have been performed by means of the pressure from the combustion chamber, i.e. the cylinder pressure.

Preferably, the pilot valve is driven by means of a pressure fluid, electromagnetically or by means of a piezo-electrical element.

According to a preferred embodiment, the pilot valve is opened for a communication between the combustion chamber and the actuator chamber by being moved in the same direction as the one in which a high pressure in the combustion chamber is acting thereon. Thereby, an opening may be accomplished also in the case that the means for driving the pilot valve ceases to function during a situation such as the one when exhaust gases are to be evacuated. Upon such an occasion, the maximum cylinder pressure may be substantially higher than the highest pressure in connection to combustion, thereby resulting in a considerable risk of having severe engine damages. Thereby, the opening of the pilot valve will occur automatically since the force generated by the cylinder pressure will be larger than the counteracting force generated by the pilot valve actuator.

An activation of a pilot valve actuator associated to the pilot valve is, preferably, initiated by means of a signal transmitted to said actuator, whereby the pilot valve will open for a communication between the actuator chamber and the combustion chamber. This will contribute to the passive security that has been described earlier, while the opposite case, in which the activation of the pilot valve was to be generated through the interruption of the signal to the pilot valve actuator, would result in an increased risk of having a collision between the engine piston and the valve.

Preferably, the valve is an outlet valve, i.e. a valve arranged so as to let the exhaust gases from the combustion chamber out to a subsequent exhaust gas system or to let the air or exhaust gases out to a pressure fluid tank connected to the combustion chamber. The latter aspect will be further described later.

The possibility of being able to open against high cylinder pressures also results in the possibility of opening a poppet valve, which is to be opened in a direction into the combustion chamber, also very late during compression strokes or very early during expansion strokes. This is an important possibility which should be taken advantage of in order to brake a vehicle by means of a compression work in order to reduce the load on the ordinary brake system and/or to store the braking-energy. As an example, lorries often have an exhaust gas brake as a supplement to the ordinary braking system. However, this method has its drawbacks as to capacity and controllability. The suggested method (the valve opener) may, on one hand, result in a maximum brake effect as the cylinder pressure can be punctured when, with regard taken to the practical possibilities, it is at its highest, and that a two-stroke operation may be applied, given that the engine valves are freely operable. On one hand, the braking effect will be very controllable thanks to the possibility of, principally, in accordance with the need of braking, opening for the discharge of a cylinder gas at any time during compression or expansion. The new possibilities are also of a great value for pneumatic hybrids by which the motor-braking of a vehicle includes that compression energy is stored as compressed air in tank in order to be used, for example, upon subsequent need of acceleration. In the latter case, i.e. during acceleration, activation is performed by means of a pilot valve that controls a flow of pressure fluid, normally pressurized air, in a channel between the actuator chamber and said tank.

Accordingly, a preferred embodiment is characterized in that, through a control of the pilot valve, the valve is opened and subsequently closed during an ongoing compression stroke or an ongoing expansion stroke, for the evacuation of gas present in the combustion chamber, and that the crank angle range within which this is done depends on a requested motor-braking effect. The requested motor-braking effect may, for example, be related to an order from a control computer, or be related to how much a control element controlled by a driver, such as a accelerator pedal, is released during operation and motor-braking. By means of the temporary opening and closing of the valve before or at the beginning of an ordinary expansion stroke, there is generated a lower pressure than normally in the combustion chamber. During the subsequent motion of the piston towards the lower dead centre, a negative pressure will, accordingly be generated in the combustion chamber since the volume of the latter is increased without any supply of fluid. The piston will work against the power of the generated negative pressure, and a braking effect will be the result. It should be mentioned that this aspect of the invention is of a general kind, and could be applicable to freely controllable valves also in cases when those are directly powered with a pressure fluid from any other pressure fluid source than the combustion chamber or are powered by an electromagnet.

The larger braking effect that is requested, the closer to the upper dead centre of the piston the valve is to be opened. Accordingly, when a maximum braking effect is to be achieved, the valve should be opened and subsequently closed during the end of a compression stroke or even during an initial stage of an expansion stroke. At high compression ratios, as for example in diesel engines, there is a risk of having a contact between the piston and the poppet valve when a large braking effect is applied. Therefore, in such cases, it is preferred to activate the device during the expansion stroke as the valve is opened in the same direction as the one in which the piston is moving, whereby the possibilities can be taken advantage of in an optimum way while, simultaneously, any possible piston contact is not as risky. The suggested device may be used as an exhaust gas brake or as a pneumatic hybrid upon use of contemporary two-stroke engines and four-stroke engines with a cam shaft for the inlet and/or outlet valves of the engine, but then not upon two-stroke operation. By engines having a pit in the piston, which is common practice for diesel engines, the main part of the compressed air would be gathered in said pit at the end of the compression stroke. The surface of the piston beside the pit and above which the engine valves are located in the cylinder head, is only a few tenths of a millimeter away from the engine valves in the cylinder head when in its nearest position thereto. If the piston is so close to the cylinder head at the end of the compression stroke and at the beginning of the expansion stroke that an activation of the discharge of air results in a contact with a piston but not any harmful such contact, that would be an optimal and preferred method.

A further embodiment is characterized in that an inlet valve is opened and subsequently closed after the opening and closure of said outlet valve, and in that this measure is performed during the end of an expansion stroke or at an initial stage of a compression stroke. Thereby, solutions that include an opening during the end of the expansion stroke and a closure during the beginning of the subsequent compression stroke are included. Thereby, fluid, preferably air, will be supplied to the combustion chamber closed to the lower dead centre of the piston, subsequent to which the piston, when it once again is moved towards the upper dead centre, would perform a compressive work. In that way, a further braking effect is guaranteed. The principal of temporarily opening the outlet valve close to the upper dead centre of the piston in connection to motor braking and subsequently temporarily opening an inlet valve in the region of the lower dead centre position of the piston will, thus, result in an improved braking effect. This aspect of the invention is of a general kind and does not require that the outlet valve be driven by a pressure fluid pressurized from the combustion chamber. The principal is also applicable in those cases when the outlet valve is directly driven by any other pressure fluid source or directly driven by an electro magnet.

According to a further aspect of the invention the pressure in the combustion chamber is used in connection to motor braking for the purpose of building up a pressure in a pressurized fluid container, and the valve is used for opening and closing the communication between said pressurized fluid container and the combustion chamber. This makes it possible, for example in connection to the above described motor braking, to take advantage of the pressure in the combustion chamber, store this energy as pressurized pressure fluid in a pressure container, and subsequently, through a suitable control of the opening and closure of the valve, deliver pressurized fluid from the pressure fluid container in order to, during a short period, for example during acceleration immediately after motor braking, operate the piston by means of this pressurized fluid. Pressurized fluid shall then, in an embodiment in which the engine operates in accordance with the two stroke principal, be let into the combustion chamber, preferably by means of the valve, close to the upper dead centre position of the piston and be discharged when the piston is close to the lower dead centre and further up to the region of the upper dead centre. The fuel can be supplied and combusted before and during the expansion stroke.

The object of the invention is also achieved by means of the initially defined device, characterized in that said communication channel extends from the combustion chamber to the actuator chamber, and in that said pressure fluid comprises a fluid pressurized by the pressure in the combustion chamber.

For reasons indicated earlier, the device preferably comprises a pilot valve for the opening/closure of the communication in the communication channel.

Preferably, the pilot valve is connected with a pressure fluid source, thereby being driven by pressurized fluid from the latter, or directly driven by an electromagnet or a piezoelectric element.

The surface onto which the fluid pressurized by the pressure in the combustion chamber acts on the actuator piston is larger than the surface with which valve points towards the combustion chamber. In practice, this is a prerequisite in order to enable this kind of operation of the valve.

As mentioned earlier when presenting the inventive method, the patent valve is, preferably, provided to open for a communication by being moved in the same direction as the one in which an over pressure in the combustion chamber acts on the latter.

According to a preferred embodiment, the valve is an outlet valve.

As an alternative, the valve may be provided to open and close the communication between the combustion chamber and a pressure fluid container in which a pressure is built up by means of the pressure in the combustion chamber in connection to motor braking, in accordance with the principal that has been described above. It may then act both as an outlet valve and as an inlet valve, depending on the operation situation.

According to a preferred embodiment, the device is characterized in that it comprises a pilot valve for the opening and closure of the communication between the pressure fluid container and actuator chamber. Preferably, the pilot valve is provided so as to brake the communication by being moved in a direction in which the over pressure in the pressure fluid container affects it. This is a question of security in order to guarantee that pressure fluid is not delivered without control to the combustion chamber from the pressure fluid container in case of a failing pilot valve.

According to one preferred embodiment, the pilot valve extends inside a stem of the valve. The communication channel previously discussed will then extend through the stem, which, in the region of the actuator chamber, preferably will be provided with one or more openings in its outer periphery, said pressure fluid being able to flow through said openings between the communication channel and the actuator chamber.

Preferably, the stem is connected with the actuator piston.

The invention also relates to a combustion engine, comprising a cylinder, a piston displacebly arranged in the cylinder, a combustion chamber delimited by the cylinder and the piston, and a valve associated with the combustion chamber, characterized in that it comprises a device according to the invention connected with the valve.

Further features and advantages of the invention will be disclosed in the following, detailed description and in the patent claims.

BRIEF DESCRIPTION OF THE DRAWINGS

The invention will now, by way of example, be described with reference to the annexed drawings, on which.

DETAILED DESCRIPTION OF PREFERRED EMBODIMENTS

Figure 1:
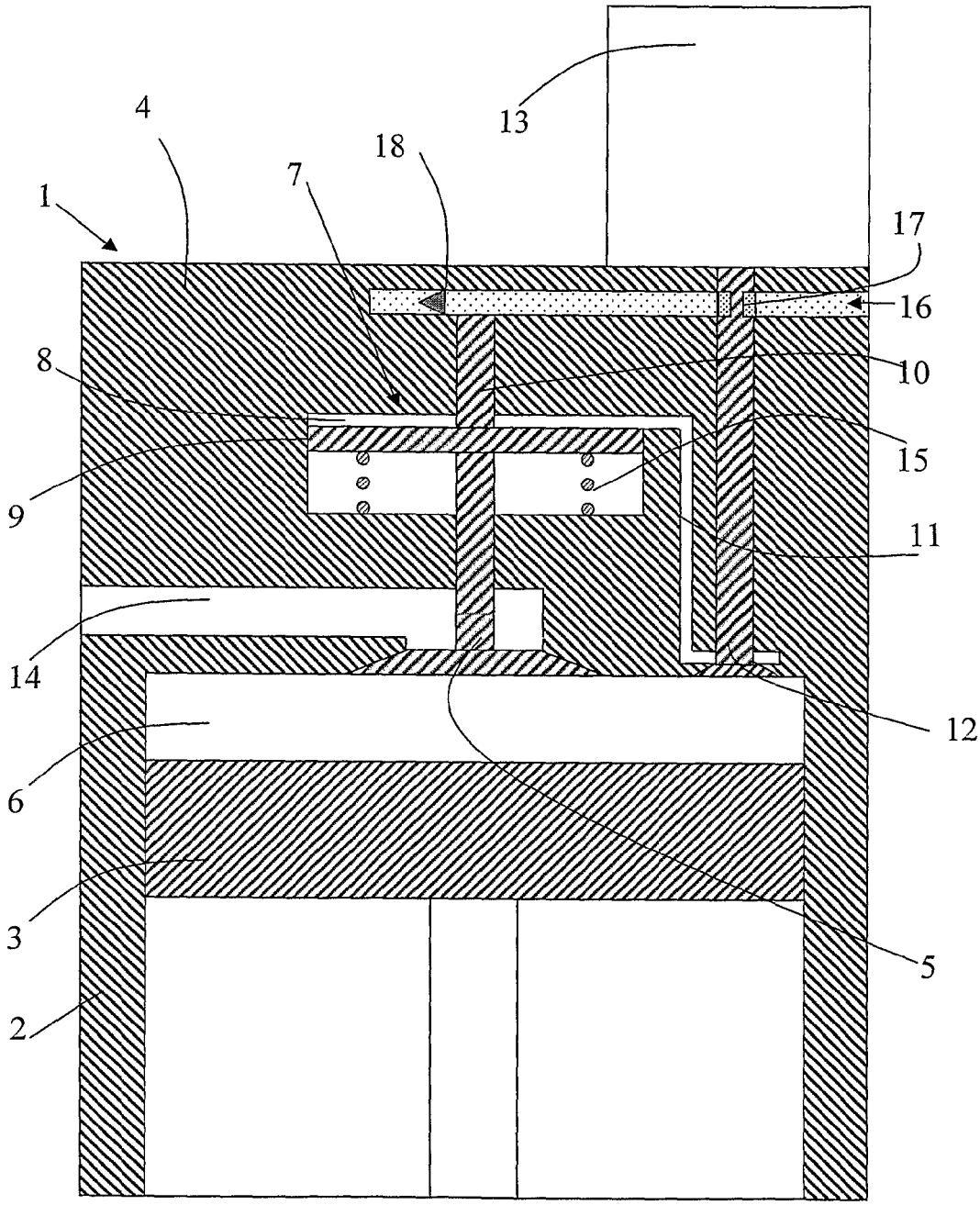
FIG. 1 is a schematic representation of the device according to the invention, as applied on a schematically represented, partly cut part of a combustion engine according to the invention.

All figures show a part of an inventive combustion engine 1, which comprises a cylinder 2, a piston 3 movably arranged in the latter, and a cylinder head 4. A valve 5 is arranged in the cylinder head 4. The valve 5 is a poppet valve. Together, the cylinder 2, the piston 3 and the cylinder 4 delimit a combustion chamber 6. The valve 5 is arranged to open by being displaced into the combustion chamber 6. When the valve closes, it will bear on a seat provided in the cylinder head 4 in a way known per se. It should realized that the engine 1 may comprise a plurality of cylinders, and that each of these may, in a way known per se, be arranged in the described way and further be provided with inlet and outlet valves, and possible separate fuel injection nozzles. The valve 5 is of a type that is freely operable and pneumatically operated.

The device according to the invention comprises a valve actuator or a valve opener 7, that comprises an actuator chamber 8 and an actuator piston 9 that is arranged to be displaced back and forth in the latter. The actuator piston 9 is connected with the valve 5 through a stem 10 arranged on the latter. Also other embodiments, by which the actuator piston 9 is indirectly connected with or arranged to mechanically propel the valve 5, are conceivable.

From the combustion chamber 6 a channel 11 leads to the actuator chamber 8. In the embodiments according to FIG. 1-FIG. 6, a pilot valve 12 is provided in the channel 11 in such a way that the pressure in the combustion chamber 6 acts on the pilot valve in a direction in which the latter is opened. In the disclosed embodiments, the pilot valve 12 is driven and controlled by a pilot valve actuator 13, that may comprise means such as a pressure fluid circuit, an electro magnet or a piezo-electric element (not shown). The pilot valve 12 may be opened through a displacement into or towards the combustion chamber 6 against the pressure in the combustion chamber 6, as in FIG. 1, or through a displacement away from the combustion chamber 6 with a contribution of the pressure from the combustion chamber 6, such as shown in FIG. 2. When the pilot valve 12 opens for a communication in the channel 11, the pressure that exists in the combustion chamber 6 will be generated also in the actuator chamber 8. A force that is proportional to said pressure and size of the surface of the actuator piston 9 onto which the pressure acts will push the valve 5 in an opening direction. This surface area of the actuator piston 9 shall be larger than the surface area of the valve 5 that points towards the combustion chamber, in order to enable the opening of the valve 5.

The valve opener 7 is activated by an opening of the pilot valve 12 in order to conduct gas of high pressure from the combustion chamber 6 into the actuator chamber 8. To keep a valve closed, or to open it against a high cylinder pressure is energy-requiring. The pilot valve 12 requires a small amount of energy, since its surface area towards the combustion chamber 6 is relatively small. In the embodiments according to FIGS. 2, 4 and 5, the pilot valve 12, for security reasons, will open in a direction away from the combustion chamber 6, and an activation of the valve opener 7 is achieved by means of braking the signal to the actuator 13 of the pilot valve 12, whereby the pilot valve 12 will open for a connection to the actuator chamber.

The more a combustion engine 1, provided with poppet valves 5 in the cylinder head 4, is loaded, the higher will the cylinder pressure be when the outlet valves 5 are to be opened, and the more energy will be required for the opening of the latter. This fact is independent of the method used for the opening of the valves. However, the invention permits the use of the energy of the pressurized fluid present in the combustion chamber, whereby the opening of the valve is guaranteed in spite of an elevated cylinder pressure.

Next will follow a brief description of each of the somewhat different embodiments shown in the figures. In the figures, details that are not specifically relevant to the invention are not shown, for example further inlet valves or outlet valves or fuel injection valves.

Figure 2:
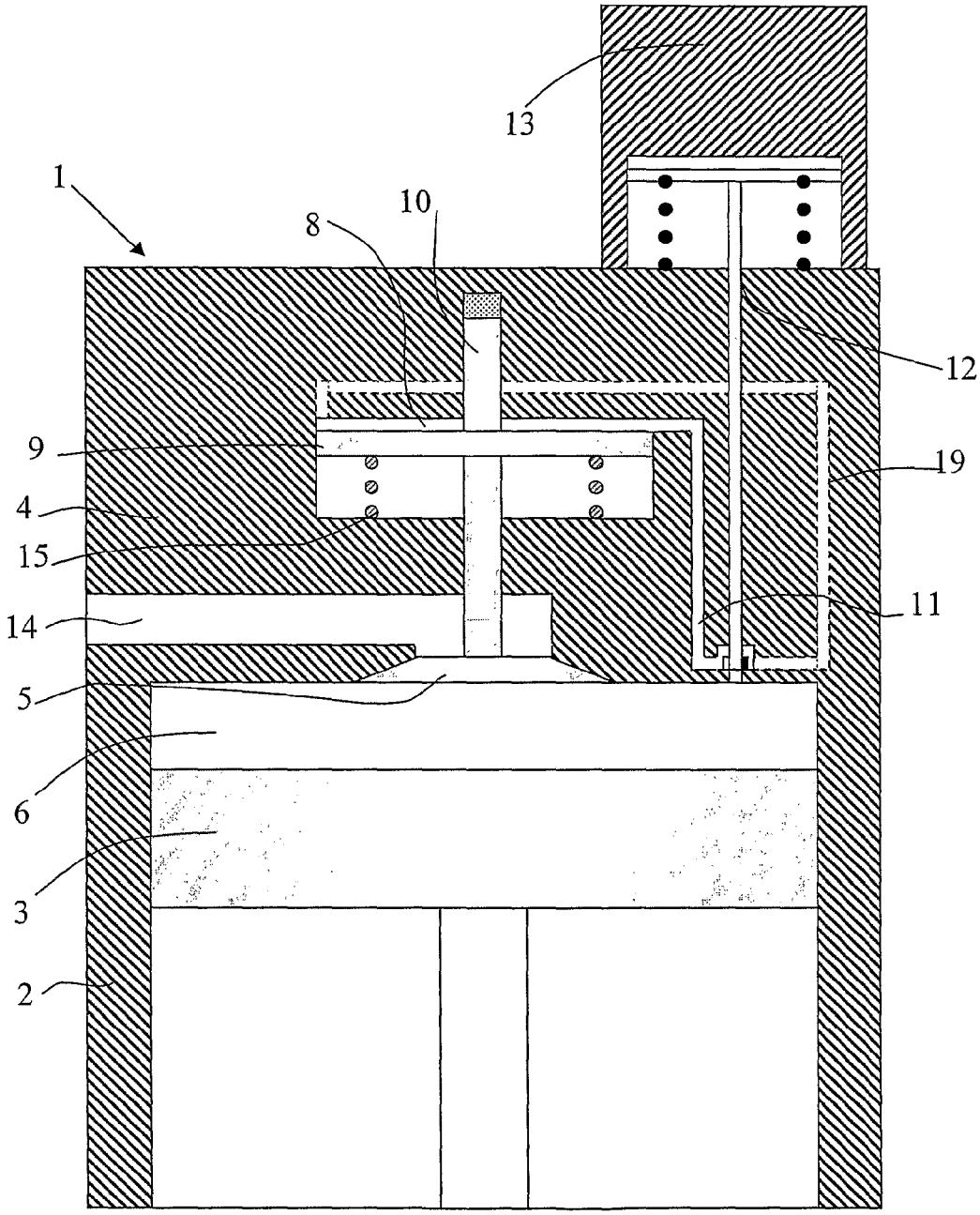
FIG. 2 is a view corresponding to the one of FIG. 1, of a second embodiment.

FIG. 1 shows a cylinder 2 with reciprocating piston 3 and a combustion chamber 6. Further, there is an exhaust gas channel 14 that, upon displacement of the valve 5 towards and into the combustion chamber 6, is brought into flow communication with said chamber 6. The valve 5 has a surface area towards the combustion chamber 6 that is smaller than the surface area of the actuator piston 9 directed towards the actuator chamber 8. Through the activation of the pilot valve actuator 13, the pilot valve 12 is displaced into the combustion chamber 6, whereby the channel 11 forms a connection between the combustion chamber 6 and the actuator chamber 8. Thereby, pressurized cylinder gas flows into, or at least in a direction towards the actuator chamber 8 and generates a pressure in the actuator chamber 8 that corresponds to the pressure in the combustion chamber 6. The pressure of the cylinder gas acts on the actuator surface of the actuator piston 9 directly towards to the actuator chamber 8, resulting in the valve 5 being displaced towards and into the combustion chamber 6, such that a connection is created between the combustion chamber 6 and the exhaust gas channel 14. Thereby, cylinder gas will be flowing out into the exhaust gas channel 14, and the pressure in the combustion chamber 6 will decrease, and, as a result thereof, the valve 5 will, due to the action of a spring that applies a force in the closing direction of the valve 5, close the connection between the exhaust gas channel 14 and the combustion chamber 6. The opening and closure of the pilot valve 12 is controlled by a pneumatic, hydraulic, electromagnetic or other type of pilot valve actuator 13. The valve 5 can be held in an open position for a requested duration by letting the pilot valve 12 close the connection between the combustion chamber 6 and the actuator chamber 8 just after the opening of the valve 5 and by means of activation of the pilot valve actuator 13, whereby pressurized cylinder gas is maintained in the actuator chamber 8. Subsequently, the connection is reopened, whereby the pressurized cylinder gas flows back to the combustion chamber 6 when the valve 5 is to be closed. In said case there is no need of the hydraulic lock that will described hereinafter. As an alternative, the valve 5 can be held in an open position for a desired duration by means of a hydraulic lock 16. When the pilot valve 12 is opened, an opening 17 in the hydraulic lock 16 is closed, and at the same time as the valve shaft 10 moves, hydraulic oil will follow the latter through a non-return valve 18. When the valve 5 has reached its extreme end position and tends to return back due to the action of the spring 15, the non-return valve 18 locks and prevents the liquid present in the hydraulic lock 16 from leaving a channel in which the liquid is located together with the shaft 10. The locking position is released when the pilot valve 12 returns to its starting position.

FIG. 2 shows a pilot valve 12 that closes towards the combustion chamber 6. In this case there is also shown a pneumatic pilot valve actuator 13 for the activation of the pilot valve 12. It is evident that there is no locking function like the one described with regard to FIG. 1 (but such a one could be arranged in a corresponding way). An activation of the actuator 13 will result in a displacement of the pilot valve 12 in a direction from the combustion chamber 6, said pilot valve thereby opening for a communication in the channel 11. This requires that the pilot valve actuator 13, regardless of its type, has such a function that, when activated, the closing force of the pilot valve 12 towards the combustion chamber 6 ceases. If the pilot valve 12 opens in a direction towards and into the combustion chamber 6, as in FIG. 1, and the pilot valve actuator 13 is unable to make the pilot valve 12 open due to the fact that it does not receive any signal or due to the fact that the cylinder pressure is to high, compressed cylinder gases may severely damage the engine.

A common feature of all figures is that the valve 5 is activated by the generation of a connection between the combustion chamber 6 and the actuator chamber 8 when the cylinder gas is to be evacuated from the combustion chamber through the valve 5. Channel 19, shown with broken lines in FIG. 2, shows an alternative, substantially longer extension of the channel 1 in the material of the cylinder, from the combustion chamber 6 to the actuator chamber 8. This longer extension is a way of increasing the volume in the channel, such that the same mass of gas will, upon mainly each opening of the valve 5, pass into and out of the actuator chamber 8, something that reduces the presence of contaminating particles from exhaust gases in the actuator chamber. Accordingly, in this case, the volume of the channel 19 is larger than the change of volume that takes place in the actuator chamber 8 during the displacement of the actuator piston 9 between the extreme positions of the latter.

Figure 3:
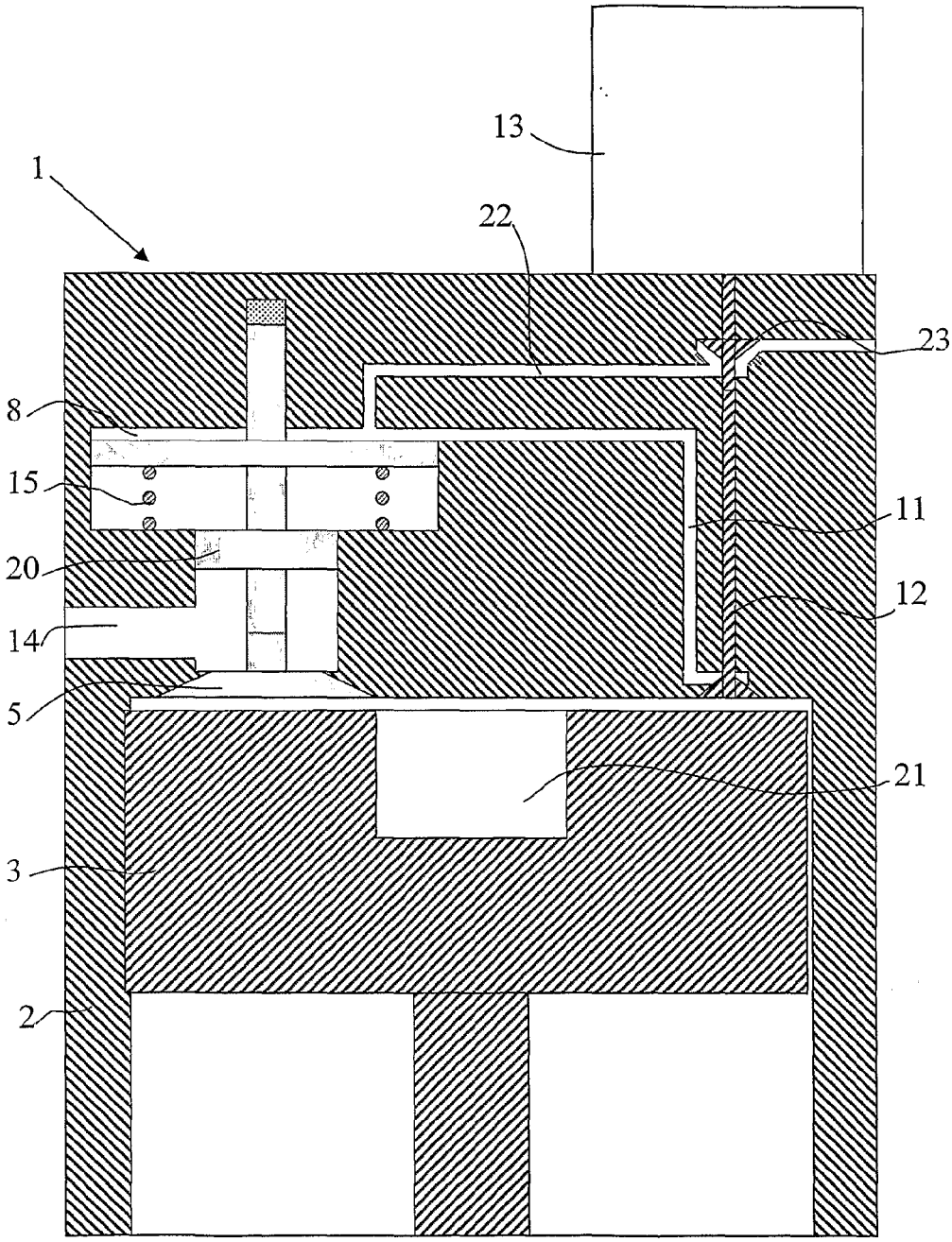
FIG. 3 is a view corresponding to the one of FIG. 1, of a third embodiment.

FIG. 3 shows a cylinder 2 of an engine of a pneumatic hybrid type. During motor braking compressed air is stored in a pressure fluid container or tank, not shown on the figure, which is connected with the channel 14. During motor braking the pressure in the tank and the channel 14 increases to a maximum, which is dependent on the compression ratio of the engine. The valve 5 has a piston 20 for the purpose of generating a force that acts upwards from the combustion chamber 6 towards the actuator chamber 8 for the purposes of preventing the valve 5 from automatically opening at the wrong occasion, or not being closed, when the pressure increases in the channel 14 during the motor braking. The piston 20 is positioned such that the pressure in the channel 14 pushes said piston 20 in a direction in which the valve 5 closes, that is in a direction towards the actuator chamber 8. The piston 3 provided in the cylinder is (in this example) provided with a piston pit 21 and is shown in its upper dead centre position with the surface of the piston 3, that is the area beside the piston pit 21, just a few millimeters from the valve 5. When the pilot valve actuator 13 activates the pilot valve 12, the latter opens for a fluid communication in the channel 11 to the actuator chamber 8 while, simultaneously, a further outlet channel 22 from the actuator chamber is closed by the pilot valve 12, or more precisely by a part 23 thereof. Advantageously, the outlet channel 22 may extend to the environment (for example into the exhaust gas pipe). Thereby, the actuator chamber 8 is pressurized, and the valve 5 is displaced until it obtains or almost obtains a contact with the piston 3, and air will start flowing from the combustion chamber 6 through the channel 14 to the pressure fluid container. During the initial motion of the piston 3 downwards during the expansion stroke, the valve 5 will follow the latter and be further opened. In order to close the connection, the channel 14, between the combustion chamber 6 and the pressure fluid container the pilot valve 12 is brought to a closure at the combustion chamber 6 through deactivation of the pilot valve actuator 13, while, simultaneously, high pressure air is led out of the actuator chamber 8 through the further channel 22, resulting in the return of the valve 5 to its starting position, shown in FIG. 3, due to the action of the spring 15.

Figure 4:
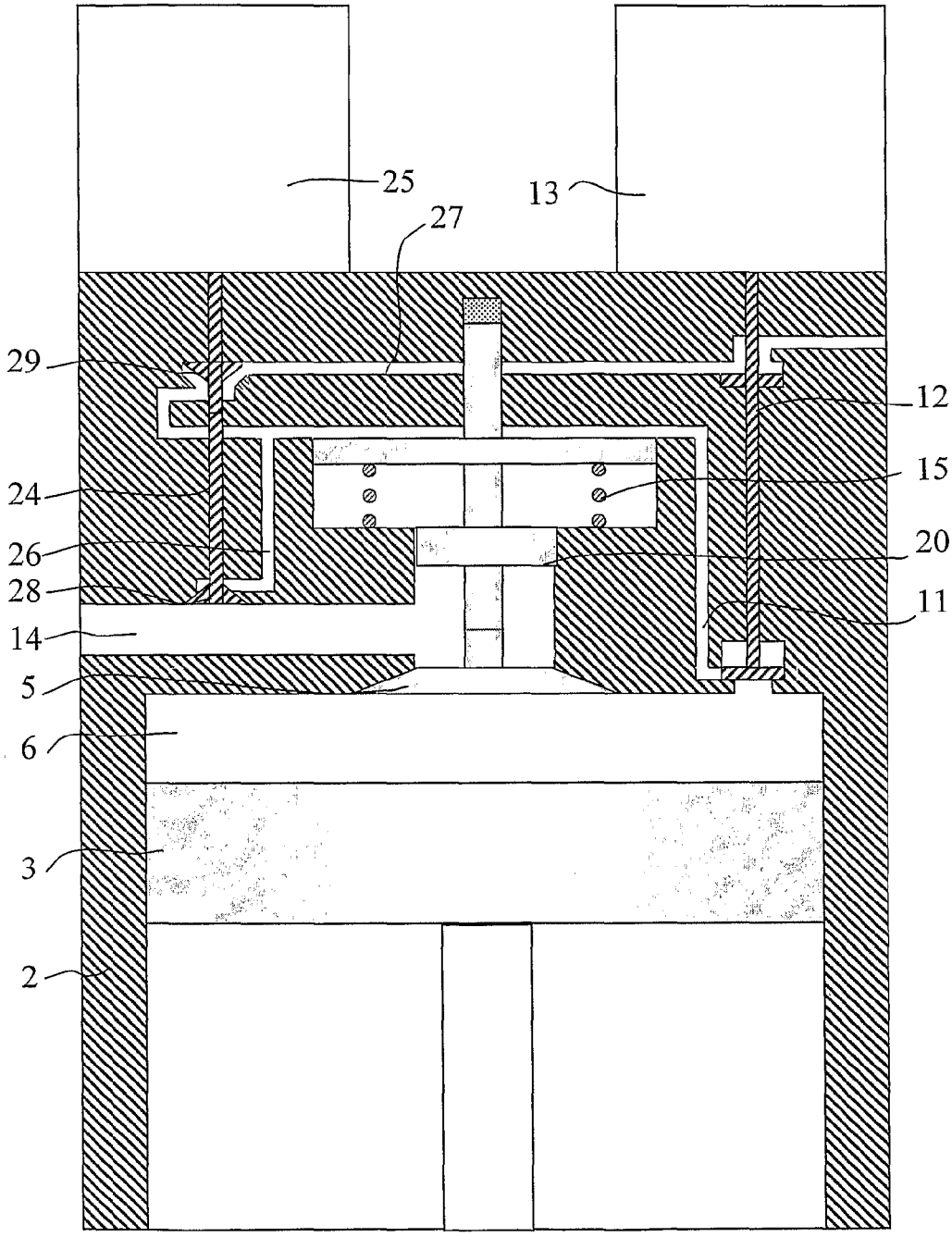
FIG. 4 is a view corresponding to the one of FIG. 1, of a fourth embodiment.

Likewise to FIG. 3, FIG. 4 shows a cylinder 2 of an engine of a pneumatic hybrid type, however differing there from in the sense that the piston 3 does not have any pit in the end thereof directed towards the cylinder head. Herein will be described how compressed air that has been stored in a tank or a pressure fluid container during motor braking is now conducted to the combustion chamber 6 through the channel 14 in order to propel the engine. This embodiment includes, apart from the first pilot valve already mentioned for the previous embodiments, a second pilot valve 24 with an associated pilot valve actuator 25 and a further channel 26 that leads from the pressure fluid container or from the channel 14 that leads to the latter, to the actuator chamber 8. A branch 27 of the further channel 26 forms an outlet channel to the environment, (for example to the exhaust gas pipe) for the pressure fluid. The second pilot valve 24 opens and brakes the communication in the second channel 26 as well as in the branch 27 of the latter, thereby opening the channel 26 when closing the branch 27 and vice versa. When the pressure fluid container is loaded with pressure fluid and the latter is to be supplied to the combustion chamber 6, the following steps are performed: In connection to the upper dead centre of the piston 3, before or at the beginning of a power stroke, the second pilot valve actuator 25 is activated, whereby the second pilot valve 24 opens the channel 26 in the region of a seat 28 and closes the branch 27 in the region of a seat 29 provided therein. Thereby, high pressure air will flow into the actuator chamber 8 and force the valve 5 to open such that a connection is generated between the channel 14 and the combustion chamber 6. Thereby, high pressure air flows from the pressure fluid container, not shown on the figure, through the channel 14 to the combustion chamber 6, in which the pressure increases and acts on the piston 3 such that the latter, during said power stroke is moved towards its lower dead centre position. When the supply of high pressure air to the combustion chamber 6 is to be broken, the second pilot valve actuator 25 is deactivated, whereby the pilot valve 24 associated thereto is brought to a closure of the further channel 26 and to open the branch 27 of the latter. This results in the high pressure air in the actuator chamber 8 flowing out through the branch 27 and in the spring 15 and pressure acting on the lower side of the piston 20 connected to the valve 5 forcing the valve 5 to brake the pressure fluid communication between the combustion chamber 6 and the channel 14. An opening motion against the pressure in the channel 14 will provide a maximum degree of safety if there should not be any signal to the second pilot valve actuator 25 but if there is such a signal to the first pilot valve actuator 13.

Figure 5:
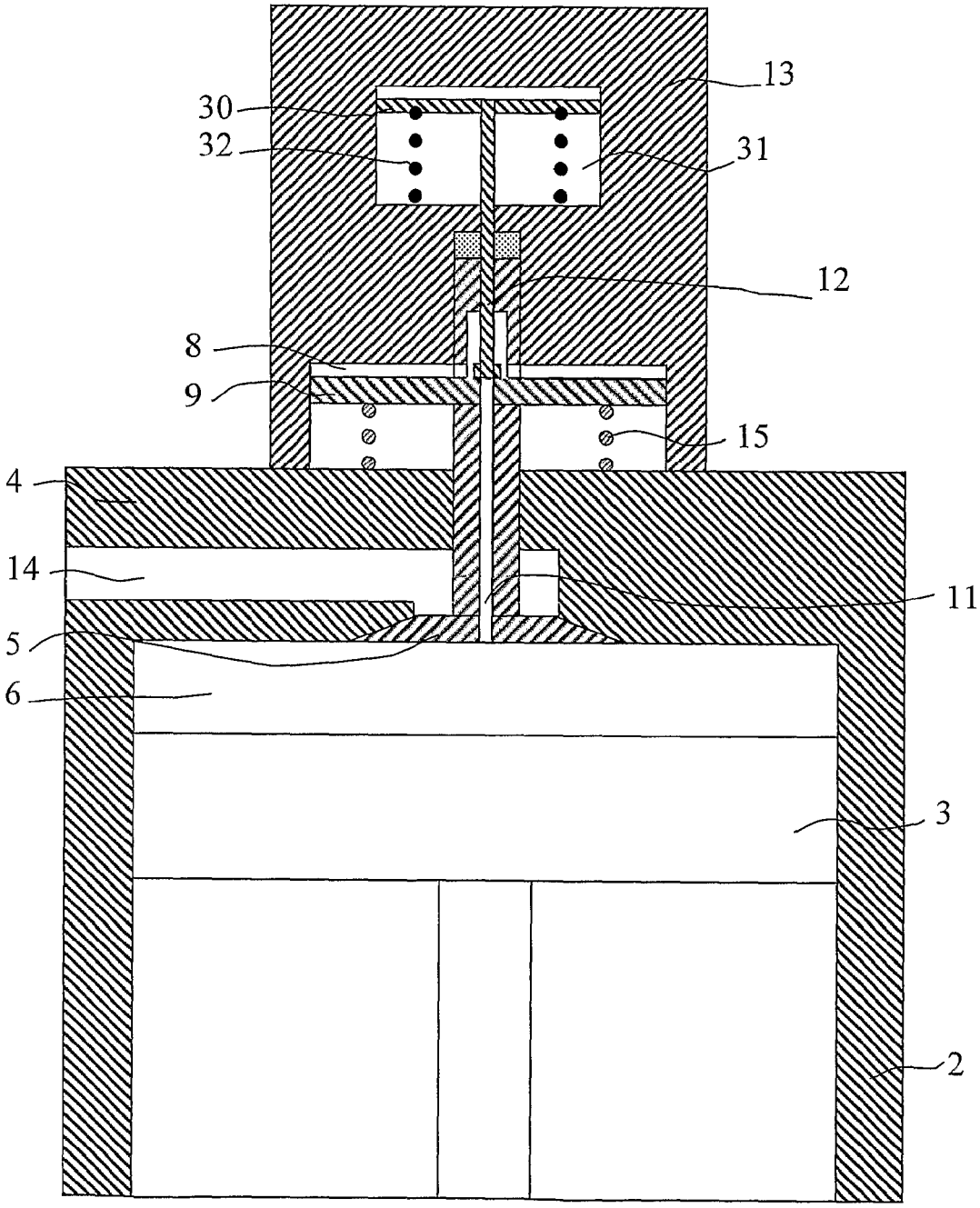
FIG. 5 is a view corresponding to the one of FIG. 1, of a fifth embodiment.
Figure 6:
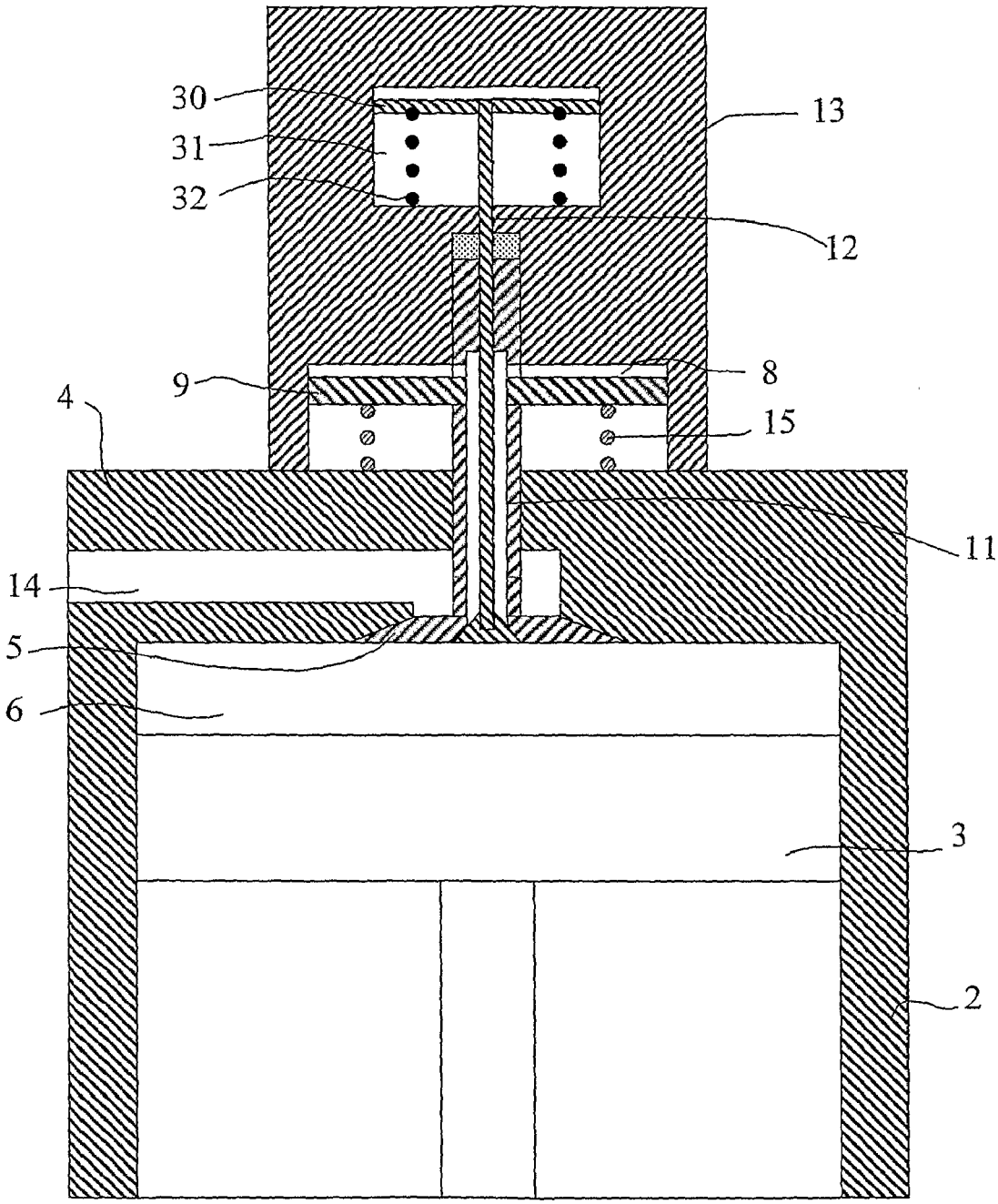
FIG. 6 is a view corresponding to the one of FIG. 1, of a sixth embodiment.

FIGS. 5 and 6 show the valve 5 with the actuator piston 9 and the spring 15 completely or partly incorporated or included in the pilot valve actuator 13. The pilot valve 12 extends in the shaft of the (slave) valve 5. Also channel 11, that connects the combustion chamber 6 with the actuated chamber 8, extends in the shaft 10 of the valve 5 and ends in the surface of the valve 5 that is turned towards the combustion chamber 6, and, through openings in the periphery of the valve shaft, in the surface of the valve shaft 10 directed towards the actuator chamber 8. The valve 5 is displaced into the combustion chamber 6 as the channel 11 is opened for a fluid communication between the combustion chamber 6 and the actuator chamber 8 by means of the pilot valve 12. In the embodiment according to FIG. 5 this is accomplished by means of a deactivation of the pilot valve actuator 13, and in the embodiment according to FIG. 6 this is accomplished by means of an activation of the pilot valve actuator 13. The difference is due to the fact that the pilot valve 12 in FIG. 5 is acted upon by the pressure in the combustion chamber 6 in such a direction that it is opened, while the pilot valve 12 in FIG. 6 is acted upon by the pressure in the combustion chamber 6 in such a direction that it closes. The pilot valve actuator 13 shown in the embodiments of FIGS. 5 and 6 is a pressure fluid actuator, for example a pneumatic actuator. Accordingly, the pilot valve actuator 13 comprises a piston 30 which is movably arranged in a chamber 31 and counteracted by a spring 32 provided in said chamber 31. The pilot valve 12 is, in other words, pneumatically operated, but it should be realized that also other ways of operating the latter are possible, for example by means of an electromagnet or by means of a piezo-electric element. Furthermore, it should be realized that this counts also for the other embodiments, in which the type of pilot valve actuator has not been defined.

The advantage of the embodiments of FIGS. 5 and 6 is the compact and less space-demanding design thereof.

Figure 7:
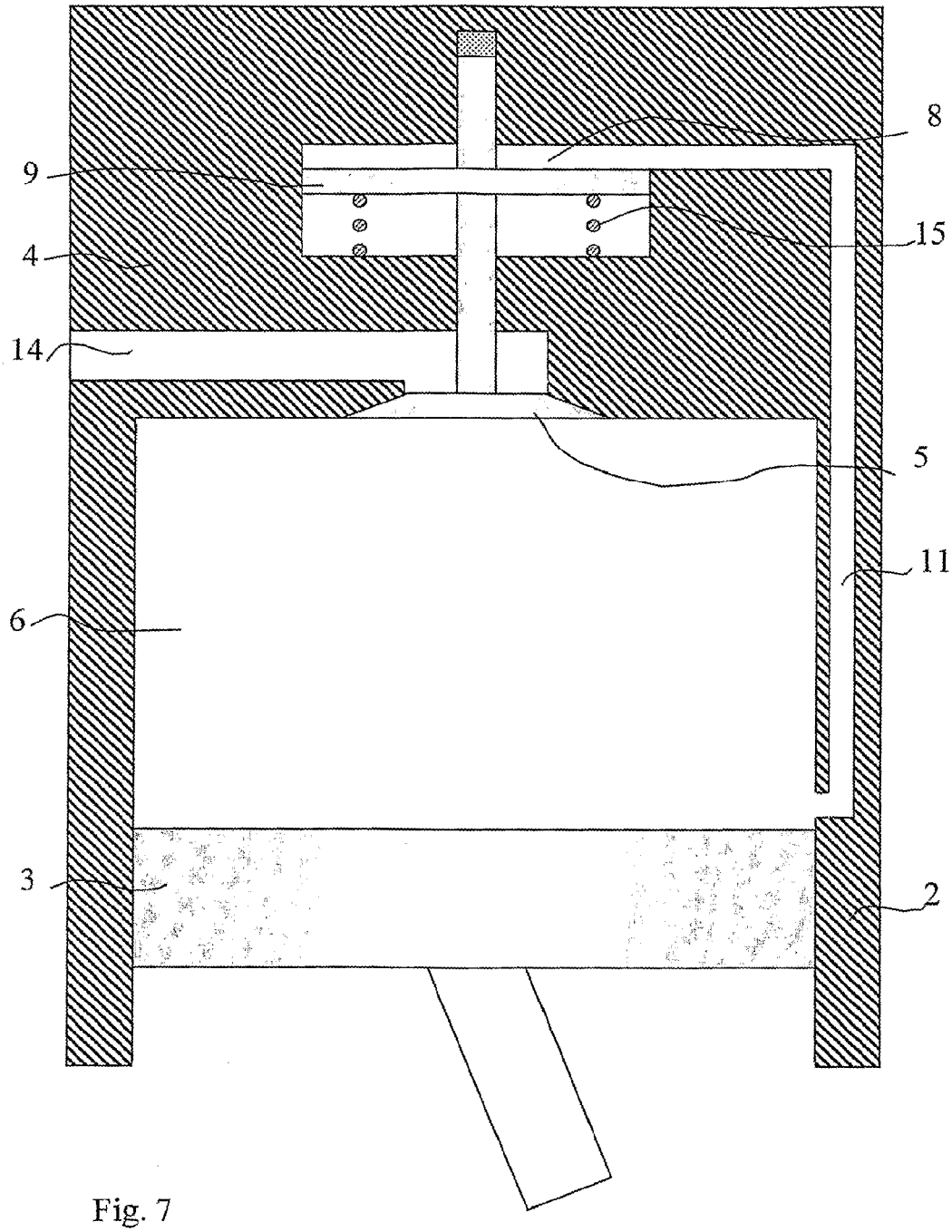
FIG. 7 is a view corresponding to the one of FIG. 1, of a seventh embodiment.

Finally, FIG. 7 shows a simplified embodiment of a device according to the invention. In this embodiment, there is no pilot valve, and channel 11 opens into the combustion chamber 6 in the cylinder wall rather than in the cylinder head 4, and said channel defines a port that is opened and closed upon basis of the position of the piston 3 reciprocating in the cylinder 2.

When the piston 3 approaches its lower dead centre position and passes the position in which the channel 11 opens in the cylinder wall, the channel 11 is opened for a pressure fluid communication between the combustion chamber 6 and the actuator chamber 8, whereby the valve 5, under assumption that the cylinder pressure is high enough, will open for an outflow of cylinder gas through the channel 14 associated to said valve 5.

A disadvantage of the embodiment according to FIG. 7 is that oil from the piston will be scratched of, introduced into and attached, through a burning process, to the channel 11 upon said passage of the opening of the channel 11 in the wall of the cylinder 2. This disadvantage is eliminated by means of pilot valves in the cylinder head, as described in the previous embodiments. Moreover, this latter solution does not result in the possibility of having a flexible control of the valve 5, as provided for by the other solutions.

It should be realized that the above description only is made by way of example, and that a plurality of alternative embodiments of the invention will be obvious for a person skilled in the art. Accordingly, the invention is primarily delimited by the features of the annexed patent claims, supported by the description and the annexed drawings.

The invention claimed is:

1. A method of operating a valve (5) to the combustion chamber (6) of a combustion engine, wherein said combustion engine comprises a cylinder (2), a piston (3) displacably arranged in the cylinder (2), a combustion chamber (6) delimited by said cylinder (2) and said piston (3), and said valve (5), and a valve actuator (7) that comprises an actuator piston (9) arranged to drive the valve (5) and provided in an actuator chamber (8), wherein a pressure fluid is conducted into the actuator chamber (8) for the driving of the actuator piston (9) and, thereby, the valve (5), characterized in that pressure fluid pressurized by the pressure in the combustion chamber (6) is conducted to the actuator chamber (8) for the driving of the actuator piston (9) in a direction in which the valve (5) is opened, in connection with the opening of the valve (5).

2. A method according to claim 1, characterized in that said pressure fluid is conducted to the actuator chamber (8) through a communication channel (11) that extends from the combustion chamber (6) to the actuator chamber (8), and in that the communication in said channel (11) is controlled by means of a pilot valve (12).

3. A method according to claim 2, characterized in that the pilot valve (12) is operated by means of pressurized fluid, electromagnetically or by means of a piezo electric element.

4. A method according to claim 2, characterized in that the pilot valve (12) is opened for communication by being displaced in the same direction as the one in which an elevated pressure in the combustion chamber (6) is acting thereon.

5. A method according to claim 4, characterized in that an activation of a pilot valve actuator (13) associated with said pilot valve (12) is triggered by means of a signal to the pilot valve actuator (13), whereby the pilot valve (12) will open for a communication between the actuator chamber (8) and the combustion chamber (6).

6. A method according to claim 2, characterized in that the valve (5), through the control of the pilot valve (12), is opened and subsequently closed during an ongoing compression stroke or during an ongoing expansion stroke, for the evacuation of a gas present in the combustion chamber (6), and in that the crank angle range within which this takes place is dependent of an ordered motor brake effect.

7. A method according to claim 6, characterized in that the opening of the valve (5) is performed closer to the upper dead end position of the piston (3) as the required braking effect increases.

8. A method according to claim 1, characterized in that the valve (5) is an outlet valve.

9. A method according to claim 1, characterized in that the valve (5) is opened and subsequently closed during a final stage of a compression stroke or during a starting stage of an expansion stroke.

10. A method according to claim 9, characterized in that an inlet valve is opened and subsequently closed after the opening and closure of said valve (5), and that this is performed during a final stage of an expansion stroke or during a starting stage of a compression stroke.

11. A method according to claim 1, characterized in that the pressure in the combustion chamber (6) in connection with motor braking is used for the purpose of building up a pressure in a pressure fluid container, and in that the valve (5) is used for the purpose of opening and closing the communication between the combustion chamber (6) and said pressure fluid container.

12. A device for the operation of a valve (5) to the combustion chamber (6) of a combustion engine, wherein the combustion engine comprises a cylinder (2), a piston (3) displacably arranged in the cylinder (2), and a combustion chamber (6) delimited by the cylinder (2) and the piston (3), and said valve (5), and wherein the device comprises a valve actuator (7) that comprises an actuator chamber (8), an actuator piston (9) displacably arranged in the actuator chamber and arranged to drive the valve (5), and a communication channel (11) through which a pressure fluid is conducted into the combustion chamber (8) for the driving of the actuator piston (9) and, thereby, the valve (5) in a direction in which the valve (5) is opened, characterized in that said communication channel (11) extends from the combustion chamber (6) to the actuator chamber (8), and in that said pressure fluid comprises fluid pressurized by the pressure in the combustion chamber (6).

13. A device according to claim 12, characterized in that it comprises a pilot valve (12) for opening/closing the communication in the communication channel.

14. A device according to claim 13, characterized in that the pilot valve (12) is connected with a pressure fluid source and is operated by the pressurized fluid thereof, or directly driven by an electromagnet or a piezo electric element.

15. A device according to claim 13, characterized in that the pilot valve (12) is arranged so as to open for communication by being moved in the same direction as the one in which an elevated pressure in the combustion chamber (6) acts thereon.

16. A device according to claim 13, characterized in that the pilot valve (12) extends inside a stem (10) associated with the valve (5).

17. A device according to claim 16, characterized in that the stem (10) is connected with the actuator piston (9).

18. A combustion engine, comprising a cylinder (2), a piston (3) displacably arranged in the cylinder (2), a combustion chamber (6) delimited by the cylinder (2) and the piston (3), and a valve (5) associated with the combustion chamber (6), characterized in that it comprises a device according to claim 17 which is connected to the valve (5).

19. A device according to claim 12, characterized in that the surface onto which the fluid pressurized by the pressure in the combustion chamber (6) acts on the actuator piston (9) is larger than the surface of the valve (5) that is directed towards the combustion chamber (6).

20. A device according to claim 12, characterized in that the valve is an outlet valve.

21. A device according to claim 12, characterized in that the valve (5) is arranged to open and close the communication between the combustion chamber (6) and a pressure fluid container in which a pressure has been built up by means of the pressure in the combustion chamber (6) in connection with motor braking.

22. A device according to claim 21, characterized in that it comprises a pilot valve (24) for opening and closure of the communication between the pressure fluid container and the actuator chamber (8).

23. A device according to claim 22, characterized in that said pilot valve (24) for the opening and closure of the communication between the pressure fluid container and the actuator chamber (8) is arranged to interrupt the communication by being moved in a direction in which an elevated pressure in the pressure fluid container acts thereon.

* * * * *